United States Patent [19]

Askjer

[11] 4,083,527

[45] Apr. 11, 1978

[54] MOULD FOR PRODUCTION OF BUILDING ELEMENTS

[75] Inventor: Leif Askjer, Lunde, Norway

[73] Assignee: A/S Selvaagbygg, Oslo, Norway

[21] Appl. No.: 693,263

[22] Filed: Jun. 4, 1976

Related U.S. Application Data

[63] Continuation of Ser. No. 525,653, Nov. 20, 1974, abandoned.

[30] Foreign Application Priority Data

Nov. 23, 1973 Norway ..... 4477/73

[51] Int. Cl.[2] ..... B22D 19/00; B28B 21/56

[52] U.S. Cl. ..... 249/91; 249/134; 425/110

[58] Field of Search ..... 249/90, 91, 134; 425/123, 124, 125, DIG. 60, DIG. 44

[56] References Cited

U.S. PATENT DOCUMENTS

| | | | |
|---|---|---|---|
| 3,641,229 | 2/1972 | Lawrence | 425/DIG. 44 |
| 3,694,533 | 9/1972 | Kelsey | 425/123 X |
| 3,883,109 | 5/1975 | Hahne | 249/91 |
| 3,891,178 | 6/1975 | Kelsey | 249/91 |

*Primary Examiner*—Francis S. Husar
*Assistant Examiner*—John S. Brown
*Attorney, Agent, or Firm*—Haseltine, Lake & Waters

[57] ABSTRACT

A mould to be used for production of building elements having fixed to one or more sides of it a layer or layers of a somewhat flexible material, which mould is made of an elastically deformable material so as to be bent and stretched away from the cast element when same has been hardened. A position of the inner surface of said mould consists of a rigid plate to which the layer or layers to be cast fast to the element is held in position during filling of the mould with moulding mass.

6 Claims, 4 Drawing Figures

MOULD FOR PRODUCTION OF BUILDING ELEMENTS

Figure 1:
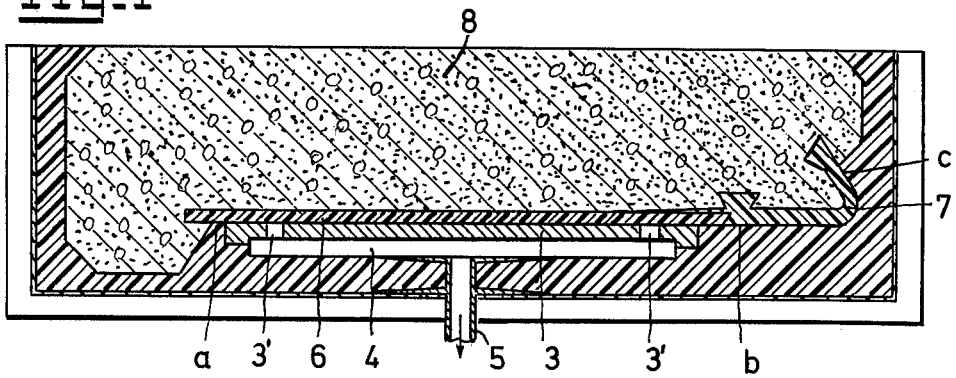

The present application is a continuation of the parent application Ser. No. 525,653, filed Nov. 20, 1974, now abandoned.

This invention relates to a mould of elastically deformable material for production of cast building elements, preferably from concrete, one or more surfaces of which elements are to be provided with a plastic layer of a somewhat flexible material, such as plastic.

From Swedish Pat. No. 219,154 is known to produce castings of for example concrete, plaster or plastics by introducing the casting material into a mould the inner surface of which is covered by a diaphragm of a flexible material, the diaphragm being held in contact with the inner walls of the mould by vacuum. When the casting is set it may be removed from the mould by replacing the vacuum by a suitable pressurizing.

From Norwegian Pat. No. 127,228 is known to produce onesided open mould pieces of fibre cement using a dish shaped supporting body, which supporting body may be secured by electromagnets or by vacuum. Further, from publicly available Norwegian patent application No. 197/68 a method and an apparatus for the production of decorated injection moulded plastic articles are known, a decorative foil being held by vacuum in the female part of the mould, followed by introducing in the mould of a casting material adhering to the foil so that after setting the foil forms an integral part of the moulded article.

From British Pat. No. 1,082,254 is known a method for producing articles of cement conglomerates and a mould to be used therefore. This mould is made from flexible or resilient material and has a rigid outer supporting frame. After the mass having hardened the supporting frame is removed and then the inner elastic mould is pulled off the moulded article which is provided with projecting portions.

As already mentioned the invention relates to a mould for production of building elements having at one or more sides a layer of a somewhat flexible material, such as plastic, which elements for instance may be staircase steps which at one or more sides are to be provided with a layer of plastic. The moulding of such building elements is a complicated procedure since the end product may be provided with sharp edges, projecting portions, recesses and different details, and a displacement of the layer during production may render the product unusable. When vibrating the mass the layer may easily be displaced so that the product cannot be used. Furthermore, leakage of concrete water will represent a disadvantage.

The aim of the invention is to avoid the above-mentioned disadvantages, which is obtained thereby that portions of the moulding recess of said mould, substantially corresponding with the surface of the plate shaped layer, are formed by a rigid plate which is arranged in the mould and against which a corresponding surface of the plate shaped layer may be kept in a predictable stable position during the moulding process.

The layer or cover may be secured to the rigid plate by vacuum, magnets, double sided adhesive tape or by temporarily supporting bolts. The preferred method for keeping the cover in place in the form is by means of vacuum.

Figure 2:
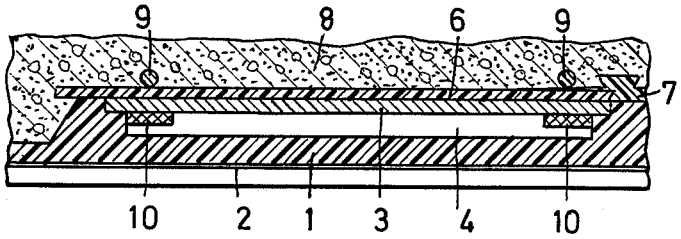
Figure 3:
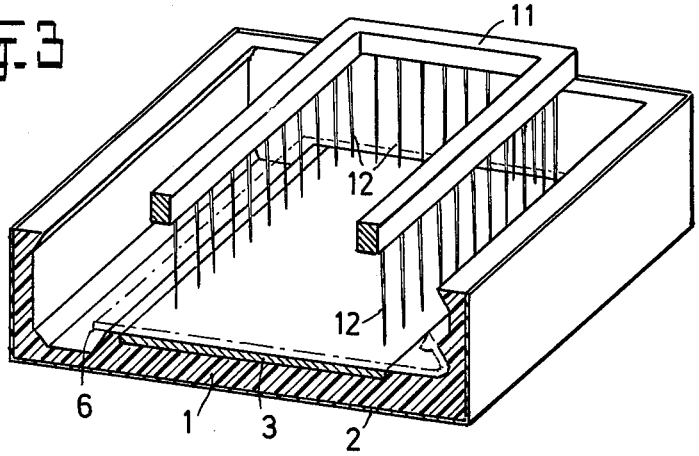
Figure 4:
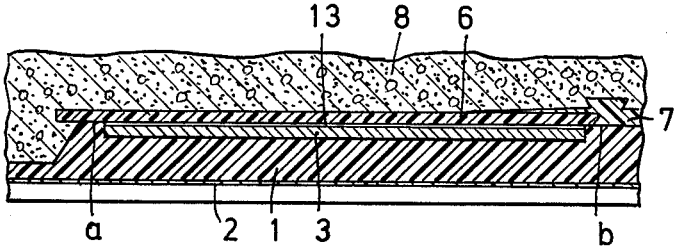

These and other features of the invention will appear from the following description of the drawing of which FIG. 1 shows a vertical section of a mould, in which vacuum is used for keeping a layer of plastic material and a front ledge or "step nose" of plastic material in place during the moulding process, FIG. 2 shows a part of another embodiment in which the layer and the nose are kept in position by means of magnets co-operating with reinforcing irons, FIG. 3 shows in perspective a part of a mould with removeable supporting bolts which keep the cover and the nose in position during the first part of the moulding process;

FIG. 4 is a sectional view of a mold and shows another embodiment of the invention where a double-sided adhesive tape is employed.

In FIG. 1 numeral 1 indicates an inner mould of elastically deformable material, such as polyurethane, which is elastic to such degree that it may, when the moulded article is to be removed from the mould, be stretched beyond the protruding portions of the ready moulded product without the mould being damaged. A rigid outer supporting mould 2 serves to secure the stability of the soft inner mould 1. A rigid, loose plate 3, for instance of steel, forms the substantial part of the bottom of the mould and defines at its inner side a vacuum chamber 4, said plate 3 being gas tight arranged within a recess of the inner mould, which recess is defined by rabbets *a* and *b* of the mould. In said plate 3 there are arranged along one or more edges through-holes 3', so that the plastic cover will be sucked to the plate when vacuum is applied to the vacuum chamber 4. Said plate 3 also serves as a flat support for the cover or covers 6 and/or 7 which are to be moulded fast to the article 8. In order to prevent the plate 3 from being bent under the influence of vacuum in chamber 4, there may be arranged distance pieces in said chamber, for instance made from rigid polyethylene. The vacuum chamber 4 is connected with a tube 5 which may be connected with a suitable suction pump, not shown.

The covers 6 and 7 to be moulded fast during the production are kept in position by being sucked to the plate 3 which is placed in a recess in the bottom of the mould 1. By means of the rabbets *a* and *b* of the mould, concrete water is prevented from escaping from the mould.

FIG. 1 also shows a front edge ledge or "nose" 7 which is also made from elastic material, such as extruded polyvinyl-chloride. Said ledge is welded or glued to the cover 6 and is kept in water tight manner against the side wall *c* of the inner mould 1 so that concrete water is also prevented from escaping at this place. The article 8 is in the present case made from concrete which may in case also be provided with reinforcing irons.

The mould according to the invention is used in the following way:

The inner mould 1 with distance elements in the vacuum chamber and with the suction tube 5 is arranged in the rigid outer mould 2, whereupon plate 3 is arranged on the bottom of the mould. Thereupon the cover 6, possibly with the front edge ledge 7 welded or glued thereto, is placed in the form, and vacuum is applied to the vacuum chamber 4, so that the cover is sucked fast to the plate 3. Then the mould is filled with concrete and in case also reinforcing iron, whereupon the concrete, if necessary, is vibrated so that the mould is completely filled with concrete. After termination of the vibration the vacuum in the chamber 4 is released and the mould placed aside for hardening. After sufficient hardening the outer mould cover layer is removed, whereupon the elastically deformable inner mould 1 is turned off the moulded article 8, so that the product is freed from the mould.

By using different inner moulds and corresponding outer moulds different building elements may be produced on one or more of the outer surfaces of which there are moulded fast covers which will be kept in correct position during the moulding process by means of suction.

FIG. 2 shows an alternative in which the retaining of the cover 6, 7 by means of vacuum has been replaced by magnets 10 which co-operate with reinforcing irons 9 arranged on the bottom of the mould 1 prior to the introduction of the mass.

A third possibility appears from FIG. 3, in which the inner mould 1, the outer mould 2 and the plate 3 are the same as already described. The cover 6 and/or the covers 6 and 7 are arranged in the bottom of the mould, whereupon on this cover or covers there is placed a frame 11 provided with a number of conically reduced bolts 12 which are longer than the thickness of the ready article and which will keep the covers 6 and/or 7 in position during introduction of the mass. After at least one half of the mass has been introduced, the frame 11 with bolts 12 may be removed, whereupon the rest of the mass is introduced and the mould is preferably vibrated in order to obtain that the recesses formed by the bolts 12 are completely filled with concrete.

A fourth possibility appears from FIG. 4 in which the reference letters *a* and *b* and reference numerals 1, 2, 3, 6, 7 and 8 are the same as in the foregoing Figs. In this case the cover 6 and possibly also the cover 7 is/are maintained in close engagement with the rigid plate-like member 3 by means of an adhesive layer 13 which may either be a layer applied to the top surface of plate 3 or by a both-sided adhesive tape.

I claim:

1. A mould for the production of cast building elements from water-containing casting material upon at least a portion of the outer surface of which there is integrally cast a cover layer of a different material, comprising a mould made of elastically deformable material and having a recessed interior portion, a rigid plate-like member positioned within said mould recess having a surface corresponding to the external surface of at least a portion of said cover layer, said mould having projection means in contact with said cover layer for preventing the escape of water from the mould upon vibration of the latter, means cooperating with said rigid plate-like member for maintaining the portion of said cover lyer overlaying said rigid plate-like member in close engagement therewith during the moulding process.

2. A mould as claimed in claim 1 wherein said rigid plate is arranged in the mould and has a number of through-holes, a recess below the rigid plate and defining together with the rigid plate a chamber connectable with a vacuum source through a tube, thereby forming the means for maintaining said rigid plate in close engagement with said cover layer.

3. A mould as claimed in claim 1, including a plurality of electromagnets at the underside of the rigid plate and cooperating with reinforcing irons placed in a mass, said electromagnets when energized pull the reinforcing irons against the cover layer and keep said cover layer in position on the upper side of said plate, thereby forming the means for maintaining said rigid plate in close engagement with said cover layer.

4. A mould as claimed in claim 1 including a frame having conically shaped bolts arranged to rest against the cover layer and keeping said layer in position against the rigid plate said bolts together with the frame being removable from the mould during filling of same with the mass and during vibration of the mould, thereby forming the means for maintaining said rigid plate in close engagement with said cover layer.

5. A mould as claimed in claim 1, wherein said cover layer is maintained in close engagement with said rigid plate-like member by providing a double-sided adhesive tape adhered to the lower surface of said cover layer and the upper surface of said plate-like member.

6. A mould as defined in claim 1, wherein said mould includes a rigid outer form receiving said mould of elastically deformable material.

* * * * *